US005460156A

United States Patent [19]

Sappington

[11] Patent Number: 5,460,156

[45] Date of Patent: Oct. 24, 1995

[54] BOW STABILIZER

[75] Inventor: Donald R. Sappington, Lake St. Louis, Mo.

[73] Assignee: Toxonics Manufacturing, Inc., Wentzville, Mo.

[21] Appl. No.: 233,754

[22] Filed: Apr. 26, 1994

[51] Int. Cl.[6] ..... F41B 5/20

[52] U.S. Cl. ..... 124/89; 188/380

[58] Field of Search ..... 124/23.1, 89; 42/1.06; 267/136, 137, 175, 177; 188/317, 322.15, 378, 380

[56] References Cited

U.S. PATENT DOCUMENTS

| | | | |
|---|---|---|---|
| 2,516,172 | 7/1950 | Baldwin . | |
| 3,149,541 | 9/1964 | Hutter et al. . | |
| 3,290,815 | 12/1966 | Edwards . | |
| 3,300,889 | 1/1967 | Baker . | |
| 3,342,172 | 9/1967 | Sanders . | |
| 3,381,405 | 5/1968 | Edwards . | |
| 3,408,062 | 10/1968 | Baker . | |
| 3,524,441 | 8/1970 | Jeffery . | |
| 3,589,350 | 6/1971 | Hoyt, Jr. . | |
| 3,628,520 | 12/1971 | Izuta . | |
| 3,670,712 | 6/1972 | Izuta . | |
| 3,683,534 | 8/1972 | Davis . | |
| 3,683,883 | 8/1972 | Izuta . | |
| 3,690,414 | 9/1972 | Aggarwal et al. | 188/378 |
| 4,126,302 | 11/1978 | Curnutt | 267/136 X |
| 4,164,825 | 8/1979 | Hutchison . | |
| 4,245,612 | 1/1981 | Finlay | 124/89 |
| 4,251,064 | 2/1981 | Camilleri | 267/136 |
| 4,279,091 | 7/1981 | Edwards . | |
| 4,346,793 | 8/1982 | Fuse et al. | 188/378 X |
| 4,351,515 | 9/1982 | Yoshida | 267/136 X |
| 4,491,123 | 1/1985 | Wirtz | 124/89 |
| 4,492,050 | 1/1985 | Kagehiro . | |
| 4,570,608 | 2/1986 | Masterfield | 124/89 |
| 4,615,327 | 10/1986 | Saunders | 124/89 |
| 4,632,228 | 12/1986 | Oster et al. | 188/282 |
| 4,893,606 | 1/1990 | Sisko | 124/89 |
| 4,982,719 | 1/1991 | Haggard et al. | 124/89 |
| 4,986,018 | 1/1991 | McDonald, Jr. | 124/89 |
| 5,044,351 | 9/1991 | Pfeifer | 124/89 |

*Primary Examiner*—John A. Ricci
*Attorney, Agent, or Firm*—Paul M. Denk

[57] ABSTRACT

A stabilizer for a bow includes a tube having a hollow body having at least one open end, a cap for the open end, a closure at an end distal from the open end, and mounting means for securing the stabilizer to the bow. Hydraulic fluid and spring biased weights are provided and mounted in the tube to absorb the vibrations caused by the firing of the bow. A central rod extends the length of the tube along the axis of the tube. The weight and springs are slidably journaled over the bar and are maintained in place, radially, in the tube by the bar.

15 Claims, 2 Drawing Sheets

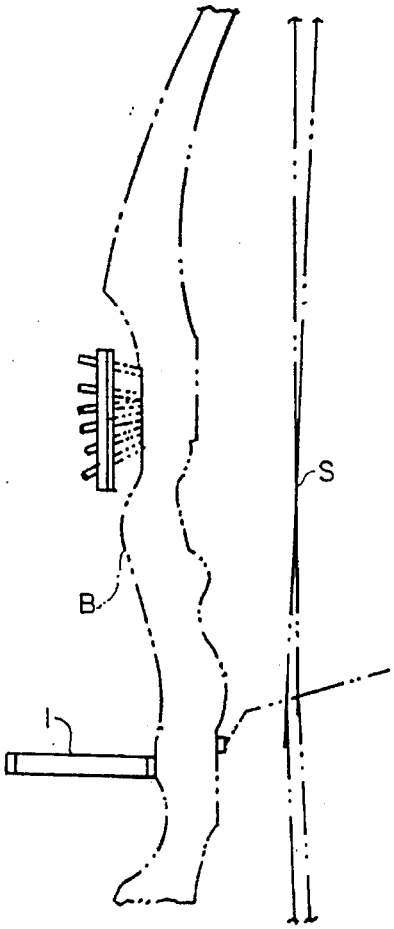
FIG. 1.
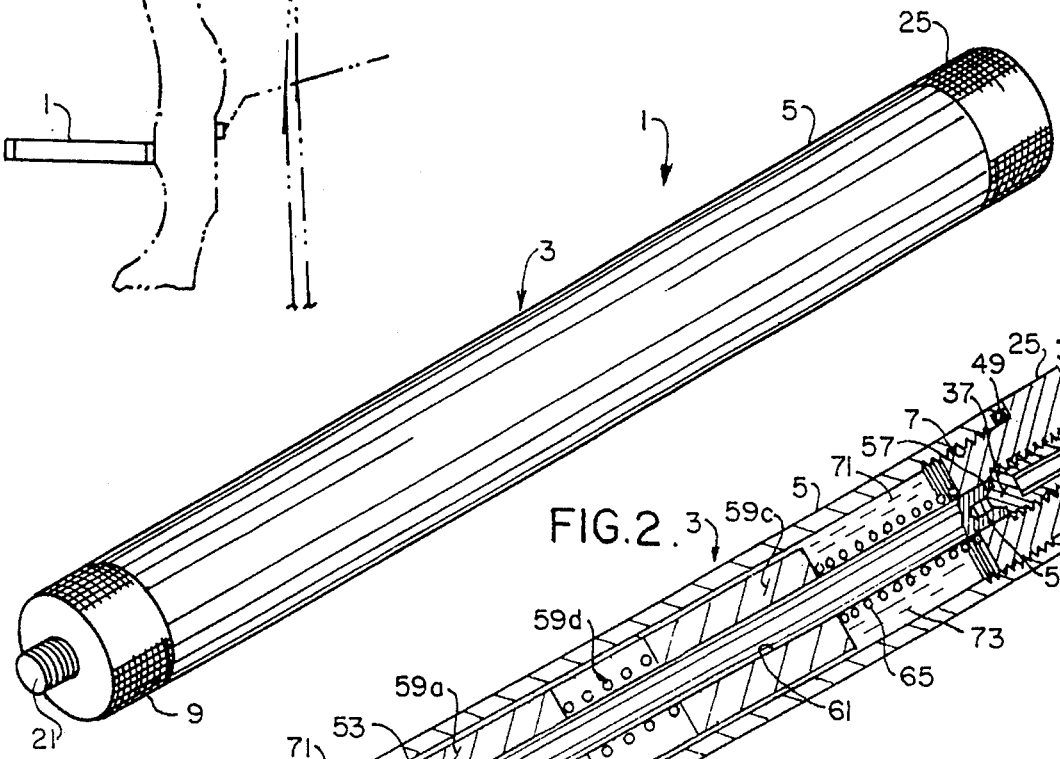
FIG. 2.
FIG. 3.

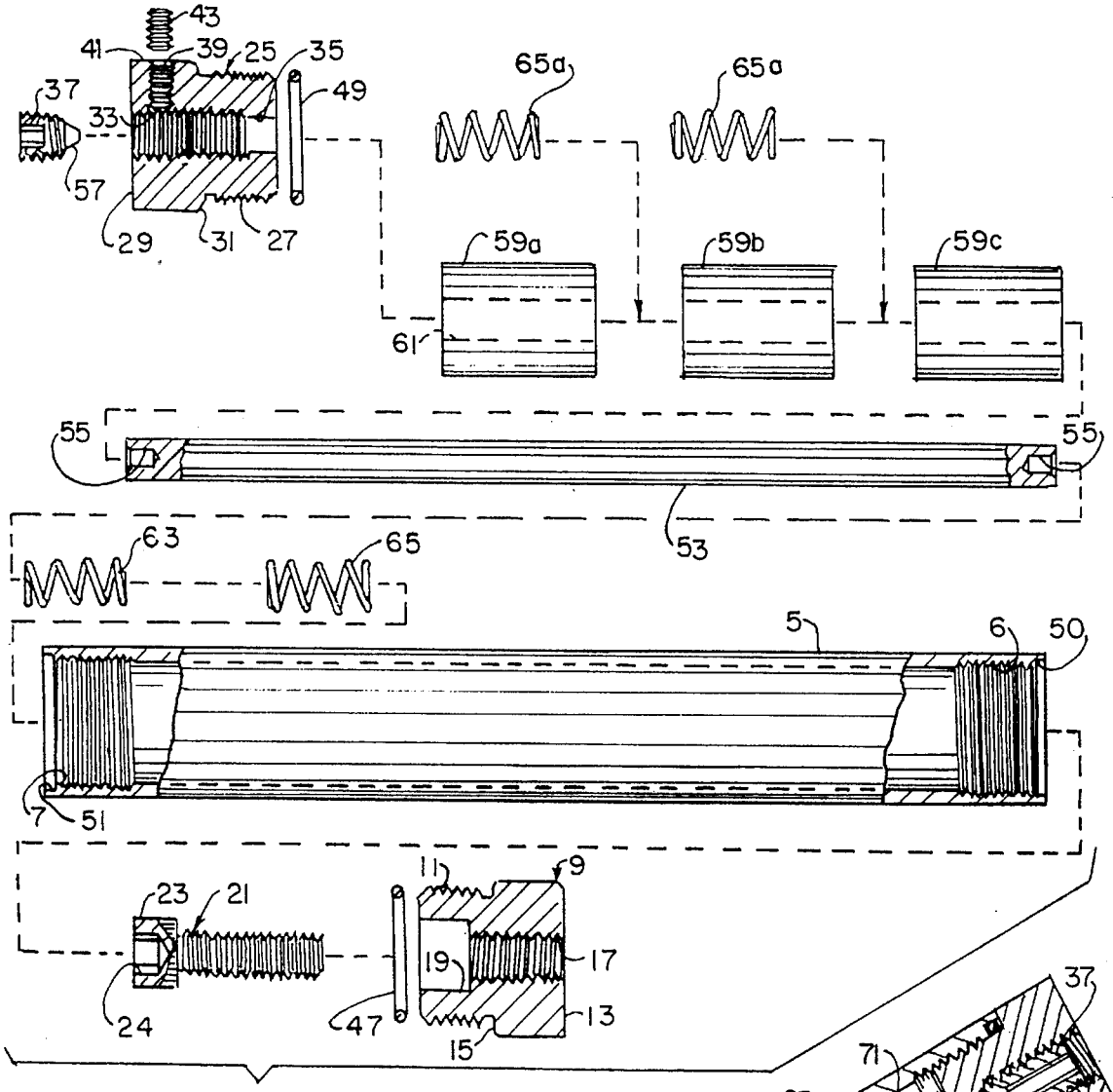
FIG. 4.
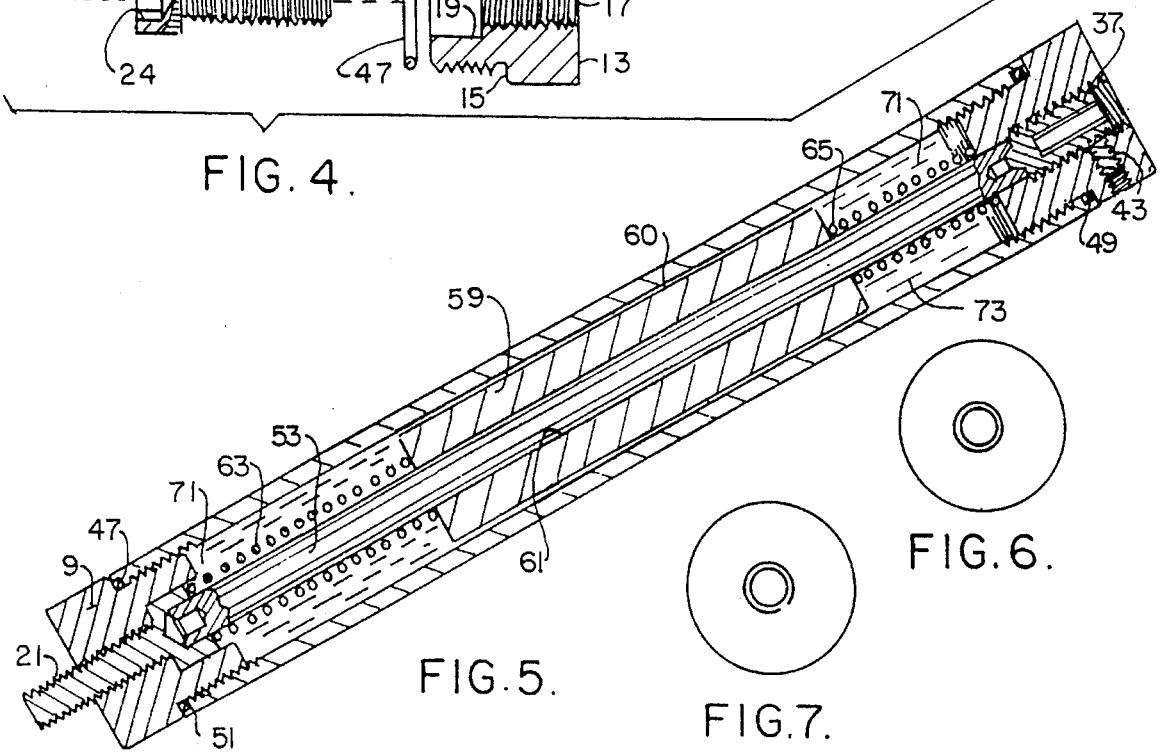
FIG. 5.
FIG. 6.
FIG. 7.

BOW STABILIZER

BACKGROUND OF THE INVENTION

This invention relates to bows, and in particular, to a stabilizer for a bow.

Target and hunting bows are complex and powerful. When fired, the strings can pass foreceful momentum and strong vibrations through the bow handle which are absorbed by the archer. These vibrations can affect the archer's aim, which will alter the trajectory of the shot. In addition, it may tire the archer prematurely during sustained use. This is undesirable in both target shooting and hunting. Further, the vibration can create a noise which can be heard by game, which is undesirable during hunting.

Stabilizers have been provided to reduce the vibrations resulting from the firing of the bow. To further reduce the noise, hydraulic stabilizers have been provided. Two such stabilizers are shown in U.S. Pat. Nos. 4,982,719 to Haggard et al, and 4,986,018 to McDonald, Jr. Both these stabilizers provide spring biased weights within a fluid filled tube which will absorb the vibrations created when the bow is shot. However, there is no mechanism which maintains the stabilizing elements centered with respect to the stabilizer body. The position of the springs could thus change, and urge the weights against the inner surface of the stabilizer body. This would severly diminish the ability of the stabilizer to absorb the impact and vibrations and may cause rubbing of the weight against the tube, which could result in undesirable noise.

SUMMARY OF THE INVENTION

One object of this invention is to provide a stabilizer for a bow or the like.

Another object is to provide such a stabilizer which operates effectively and quietly.

Another object is to provide such a stabilizer which maintains the elements of the stabilizer centered with respect to the stabilizer's body and contains hydraulic fluid therein.

These and other objects will become apparent to those skilled in the art in light of the following disclosure and accompanying drawings.

Briefly stated, a stabilizer for a bow includes a hollow body having at least one open end, a cap for the open end, a closure at an end distal from the open end, and mounting means for securing the stabilizer to the bow. Spring biased weights are mounted in the tube to absorb the vibrations caused by the firing of the bow. A central rod extends the length of the tube along the axis of the tube. The weight and springs are slidably journaled over the bar and are maintained in place, radially, in the tube by the bar. By maintaining the weights in the center of the tube, the weights are prevented from being forced against the tube by misalignment of the springs. The use of the centering bar thus facilitates quieter operation of the stabilizer for a longer period of time. As the stabilizer would not operate properly if the weights were urged against the tube, the stabilizer also facilitates continued operation of the stabilizer. More importantly, the stabilizer contains a supply of hydraulic fluid within its tube to ensure the most efficient and quiet operation.

BRIEF DESCRIPTION OF THE DRAWINGS

FIG. 1 is a side elevational drawing showing a stabilizer of the present invention mounted on a bow,shown in phantom;

FIG. 2 is an enlarged isometric view of the stabilizer;

FIG. 3 is a cross-sectional view of the stabilizer;

FIG. 4 is an exploded view, partly in cross-section, of the stabilizer;

FIG. 5 is a cross-sectional view of a second embodiment of my stabilizer;

FIG. 6 is a front plan view of the stabilizer; and

FIG. 7 is a rear plan view of the stabilizer.

DESCRIPTION OF THE PREFERRED EMBODIMENT

Referring now to the FIG. 1, reference numeral 1 indicates one illustrative embodiment of a bow stabilizer of the present invention mounted on a bow B. When fired, the strings S of bow B can create substantial vibrations. Stabilizer 1 absorbs the vibrations so that the archer does not have to and reduces noise created by the vibrations. Although the stabilizer is shown being used with a bow, it will be apparent that the stabilizer may have applicability with guns, and other vibration creating weapons.

Stabilizer 1 includes a body 3 made of an open ended, hollow tube 5. The open ends of tube 5 are internally threaded, as at 6 and 7. A first cap 9 is screwed into tube 5 to close end 6. Cap 9 has a externally threaded stem 11 which is received on threads 6 and a head 13. Head 13 has a diameter approximately equal to the outer diameter of tube 5 and thus forms a shoulder 15 with stem 11. Cap 9 has a centrally located, axially extending threaded bore 17 which is counter-bored, as at 19. A screw 21 is received in bore 17, the head 23 of the screw being received in counter-bore 19. The screw extends beyond the outer surface of cap 9, as shown in FIGS. 2 and 3 to removably secure stabilizer 1 to the bow B, as is known in the art. Screw head 23 has a bore 24 formed therein.

A second cap 25 closes the other end of tube 5. Like cap 11, cap 25 has a threaded stem 27 and a head 29 which forms a shoulder 31. Cap 25 has a centrally located, axially extending bore 33. Bore 33 is substantially fully threaded. However, it is not threaded at the inner end of the bore, as at 35. A set screw 37 is received in bore 33 to close bore 33. A second threaded bore 39 extends inwardly from a side 41 of head 29 and intersects bore 33. A second set screw 43 is received in bore 39 and bears against set screw 37 to maintain it in place.

As will be discussed below, tube 5 is filled with fluid, such as a hydraulic fluid. A pair of O-rings 47 and 49 are fitted between the tube 5 and caps 11 and 25, respectively, to make the connection between the caps and the tube fluid tight. Tube 5 defines a pair of shoulders 50 and 51 on which the O-rings are seated. The shoulders 15 and 31 of the caps seat against the O-rings to make the connection between the caps and the tube fluid tight.

A centering bar 53 is received in tube 5. Bar 53 is solid, but may be hollow to reduce weight. Bar 53 has at least one bore 55 formed at one of its ends. Preferably, a bore 55 is formed at each end. If the tube were hollow, the bore 55 would be defined by the hollow tube. Bar 53 extends the full axial length of tube 5. It is preferably cylindrical and has a diameter slightly smaller than the diameter of screw bore 24 and cap bore 35 to be received therein.

Bar 53 is held in its central position by set screw 37. Set screw 37 has a tapered end 57 which is received in bar bore 55. As the set screw 37 is screwed into cap bore 33, the tapered end 57 extends into bar bore 55 to urge the bar into screw bore 24. Bar 55 thus is sandwiched by the end of screw bore 24 and the set screw 37. The interaction of the set screw end 57 with bar bore 55 will also tend to center the bar in the tube and prevent movement of the bar relative to the tube.

At least one weight 59 is slidably received on bar 53. In FIG. 5, one weight 59 is shown. In FIGS. 3 and 4, two or three weights, respectively, 59*a–d* are shown. The number and magnitude of weights can be any desired amount and will vary depending on the amount of vibration that needs to be absorbed. A bow which creates a great deal of vibration will need more weight than a bow which creates only a slight vibration. Whether the weight is a single weight, or made of multiple weights is a matter of choice, and depends in part upon the availability of weights in the desired magnitude. Weight(s) 59 is preferably cylindrical, although it may be any shape, as long as it can fit within tube 5 and slide therein. A gap 60 should be formed between weight 59 and the inner surface of tube 5. Weight 59 also has a bore 61 through which bar 53 extends. Bore 61 is sized so that weight 59 may easily slide over bar 53.

Weight 59 does not extend the full length of tube 5, and is biased towards the center of the tube by the springs 63 and 65. The spring 63 is positioned between cap 9, and the weight 59, and spring 65 is positioned between the cap 25, and the weight 59. In FIG. 3, the weight is separated into two weights, 59A and 59C. A spring 59D separates the two weights 59A and 59D, as shown. In addition, as can be seen in FIG. 4, the weight 59 is separated into three different weights, No. 59A through 59C. The spring 63 is positioned between the weight 59A, and the cap 9. Then, springs 65A, one each positions between the respective weights 59A and 59B, in addition to between weights 59B and 59C. Finally, the spring 65 positions between the weight 59C, and the cap 25. These are examples as to how the stabilizer can be varied, with respect to its weights, as mounted upon the bar 53, in variations in the construction of the bow stabilizer. As noted, the springs sit on the axial ends of the various weights, or between weights, and on the inner axial surfaces of the caps to bias the weights towards the center of the tube 5 and to position them with respect to each other. The springs 63 and 65 may be single springs, or may be made of a plurality of springs, as required.

The area 71 not filled with the weight(s) 59 is filled with a fluid, preferably a liquid, 73. The fluid has a viscosity which will allow easy, and nearly instantaneous movement of weight 59 in response to vibration of the bow B and add a shock absorbing attribute to the stabilizer.

To assemble the stabilizer, mounting screw 21 is screwed into first cap 9. Cap 9, with O-ring 47 seated in tube 5, is mounted to tube 5 to close end 6 of the tube. Bar 53 is then inserted into the tube with its end being placed in screw bore 24. Spring 63, spring 59d, weight(s) 59, and spring 65 are then journaled over bar 53. The tube is then filled with fluid 73 such that the tube will be nearly completely filled when fully closed. Cap 25 is then secured to the tube 5, with the other end of bar 53 being received in cap bore 35. Set screw 37 is then screwed into bore 33 to position and lock bar 53 in the center of tube 5. Set screw 43 is then inserted into bore 39 to prevent loosening of set screw 37. The stabilizer can then be mounted to the bow B.

The use of centering tube 53 maintains the weight(s) 59 in the center of the tube 5 and maintains the gap 60 between the weight 59 and tube 5 so that the weight cannot be pushed against the tube by the springs. Centering tube 53 will thus further insure quiet operation of stabilizer, by maintaining the gap 60, and will prevent the weight from binding against the tube, which would prevent efficient operation of the stabilizer.

Variations, within the scope of the appended claims, may be apparent to those skilled in the art. For example, the tube 5 could be formed having one closed end, rather than two open ends. Bore 24 could then be formed in the closed end, and only cap 25 would be needed. This variation is illustrative only.

I claim:

1. A stabilizer for a bow, the stabilizer including a tube having a hollow body and having at least one open end, a cap for said open end, a closure at the end distal from said open end of said tube, mounting means for securing said stabilizer to said bow, a central rod extending the length of said tube along the axis of said tube, at least one weight slidably mounted on said rod, said weight being sized and shaped so that it may easily slide within said tube, a first spring mounted on said rod between said weight and said cap, and a second spring mounted on said rod between said weight and said closure, the space of said tube not being occupied by said weight and springs being filled with a fluid, said closure and said cap each define a bore, said bores receiving opposite ends of said central rod to center said rod with respect to said tube, said cap defining a centrally located through-bore extending axially through said cap, said through-bore receiving a screw to fix said central rod in said tube, said closure forming a blind bore to accommodate the opposite end of the central rod therein.

2. The stabilizer of claim 1 wherein said central rod defines a bore at each end thereof, said through-bore screw being received in one of the central rod end bores to position said central rod axially within said tube.

3. The stabilizer of claim 2 wherein said through-bore screw has a tapered end, said tapered end being received in said one central rod end bore.

4. The stabilizer of claim 3 wherein said cap defines a second bore extending perpendicularly to said through-bore and intersecting therewith, said second bore receiving a set screw for preventing movement of said through-bore screw.

5. The stabilizer of claim 1 wherein said mounting means includes a screw threadedly engaging within said closure bore and extending longitudinally from said closure.

6. The stabilizer of claim 5 wherein said tube is opened at both ends, the closure of said stabilizer comprising a second cap which closes the end opposite said first cap, said second cap defining a bore which receives said mounting screw such that said screw extends externally of said tube, said screw having a head defining said blind bore which receives one end of said central rod.

7. The stabilizer of claim 6 wherein said first and second caps are threadedly received in said tube ends.

8. The stabilizer of claim 1 wherein there are two weights provided within said tube upon said central rod, and another spring provided between said weights.

9. A stabilizer for a bow containing a supply of hydraulic fluid, the stabilizer including a tube having a hollow body and having at least one open end, a cap for said open end, a closure for the tube at its end distal from said open end, mounting means for securing said stabilizer to said bow, at least one weight slidably carried in said tube and exposed to said hydraulic fluid, said at least one weight being sized and shaped so that it may easily slide within said tube, and spring means mounted in said tube to bias said at least one weight towards an axial center of said tube, centering means for maintaining said at least one weight axially centrally located in said tube, said centering means includes a bar extending axially through said tube, along a central axis of said tube, said closure and cap each define bores, said bores receiving opposite ends of said bar to center said bar with respect to said tube, said cap bore being a through-bore, said through-bore receiving a screw which removably fixes said bar in said tube.

10. The stabilizer of claim 9 wherein said bar defines a bore at one end thereof, said bar bore receiving said through-bore screw.

11. The stabilizer of claim 10 wherein said through-bore screw has a tapered end, said tapered end being received in said bar bore.

12. The stabilizer of claim 11 wherein said tube has two open ends, and said closure comprising a second cap which closes the tube end opposite said first cap.

13. The stabilizer of claim 12 wherein said second cap receives a mounting screw for mounting said stabilizer to said bow.

14. The stabilizer of claim 13 wherein said mounting screw has a threaded portion extending externally of said second cap, and said screw having a head, said head defining one of said bores which receives the proximate end of said bar.

15. The stabilizer of claim 9 wherein there are two weights provided within said tube upon said bar, and another spring provided between said weights.

* * * * *